US007971596B2

(12) United States Patent
Morris et al.

(10) Patent No.: US 7,971,596 B2
(45) Date of Patent: Jul. 5, 2011

(54) PORTABLE CONFINEMENT DEVICE

(76) Inventors: Rose Morris, Wexford, PA (US); Jeff Morris, Pittsburgh, PA (US); Mark Ewing, Farmers Branch, TX (US)

( * ) Notice: Subject to any disclaimer, the term of this patent is extended or adjusted under 35 U.S.C. 154(b) by 30 days.

(21) Appl. No.: 12/552,402

(22) Filed: Sep. 2, 2009

(65) Prior Publication Data

US 2011/0048481 A1 Mar. 3, 2011

(51) Int. Cl.
*E04H 15/02* (2006.01)
*E04H 15/42* (2006.01)

(52) U.S. Cl. ..... 135/96; 135/133; 135/136; 135/156; 5/93.1; 5/414

(58) Field of Classification Search ..... 135/95–96, 135/132–133, 137, 156, 116, 88.07, 88.16; 5/93.1, 97, 98.3, 99.1, 658, 112–113, 414–416
See application file for complete search history.

(56) References Cited

U.S. PATENT DOCUMENTS

| | | | | | |
|---|---|---|---|---|---|
| 1,557,382 | A | * | 10/1925 | Sundback | 24/387 |
| 3,071,782 | A | * | 1/1963 | Ball | 5/97 |
| 3,578,003 | A | | 5/1971 | Everett | |
| 4,044,411 | A | * | 8/1977 | Peterson | 5/99.1 |
| 4,237,914 | A | | 12/1980 | Gantz | |
| 4,271,856 | A | * | 6/1981 | Ferguson | 135/132 |
| 4,531,330 | A | | 7/1985 | Phillips | |
| 4,641,387 | A | | 2/1987 | Bondy et al. | |
| 4,692,953 | A | * | 9/1987 | Fetters | 5/99.1 |
| 4,852,598 | A | | 8/1989 | Griesenbeck | |
| 5,384,925 | A | | 1/1995 | Vail | |
| 5,449,014 | A | | 9/1995 | Yan-ho | |
| 5,697,320 | A | * | 12/1997 | Murray | 114/361 |
| 5,718,254 | A | | 2/1998 | Murphy | |
| 5,784,732 | A | | 7/1998 | Vail | |
| 5,926,873 | A | * | 7/1999 | Fountain | 5/424 |
| 6,123,091 | A | * | 9/2000 | Flynn et al. | 135/96 |
| 6,139,046 | A | * | 10/2000 | Aalund et al. | 280/642 |
| 6,192,909 | B1 | | 2/2001 | Strausser | |
| 6,216,291 | B1 | | 4/2001 | Eads et al. | |
| 6,220,264 | B1 | | 4/2001 | Newman | |
| 6,263,529 | B1 | | 7/2001 | Chadwick et al. | |
| 6,487,735 | B1 | | 12/2002 | Jacques, II et al. | |

(Continued)

FOREIGN PATENT DOCUMENTS

GB 444761 3/1936

(Continued)

OTHER PUBLICATIONS

Pedicraft brand Rover brand Stretcher Crib brochure, printed out Dec. 8, 2008 from www.pedicraft.com (5 pages).

(Continued)

*Primary Examiner* — Winnie Yip
(74) *Attorney, Agent, or Firm* — IP & Internet Law North, LLC; Thomas Lizzi

(57) ABSTRACT

A portable confinement device for confining a person upon a mattress is provided. The device includes a frame and a flexible enclosure. The enclosure is supported by and sits upon the frame to stabilize the device from tipping over. A mattress may be received into the interior space of the enclosure. The enclosure includes an opening for allowing a person to enter or exit the interior space of the enclosure. All openings of the enclosure are designed to be unfastened only from outside of the enclosure.

16 Claims, 7 Drawing Sheets

U.S. PATENT DOCUMENTS

| | | | | |
|---|---|---|---|---|
| D475,660 | S * | 6/2003 | Licciardello | D12/129 |
| 6,687,930 | B1 | 2/2004 | Eads et al. | |
| 6,704,949 | B2 * | 3/2004 | Waldman et al. | 5/93.1 |
| 6,728,981 | B1 | 5/2004 | Gutierrez | |
| 6,772,458 | B2 | 8/2004 | Ellen et al. | |
| 6,799,339 | B2 | 10/2004 | Stewart | |
| 6,859,958 | B2 * | 3/2005 | LaMantia | 5/97 |
| 6,952,844 | B2 | 10/2005 | Danaher | |
| 7,062,806 | B2 | 6/2006 | Merlin | |
| 7,100,221 | B1 | 9/2006 | Twigg | |
| 7,107,926 | B2 * | 9/2006 | Fishburn | 114/361 |
| 7,174,584 | B2 | 2/2007 | Danaher | |
| 7,383,849 | B2 | 6/2008 | Kline | |
| 7,392,555 | B2 | 7/2008 | Danaher | |
| 7,434,280 | B2 | 10/2008 | Cyr | |
| 7,472,436 | B1 | 1/2009 | Barrett | |
| 7,562,690 | B1 | 7/2009 | Loweth | |
| 2002/0157697 | A1 * | 10/2002 | Choi | 135/119 |
| 2006/0266399 | A1 | 11/2006 | Ferrari | |
| 2007/0294827 | A1 | 12/2007 | Carr et al. | |
| 2008/0216881 | A1 | 9/2008 | Ganz | |

FOREIGN PATENT DOCUMENTS

| | | |
|---|---|---|
| WO | 87-06293 | 10/1987 |

OTHER PUBLICATIONS

Pedicraft brand canopy enclosed bed webpage, printed out Dec. 8, 2008 from www.pedicraft.com (1 page).

New Care brand Soma Safe Enclosure brochure, printed out Dec. 8, 2008 from www.newcaretherapies.com (1 page).

Chris, Noah's World Beds, web article, dated Jul. 20, 2009, printed out from noahsworldllc.com/category/noahs-world-beds (3 pages).

* cited by examiner

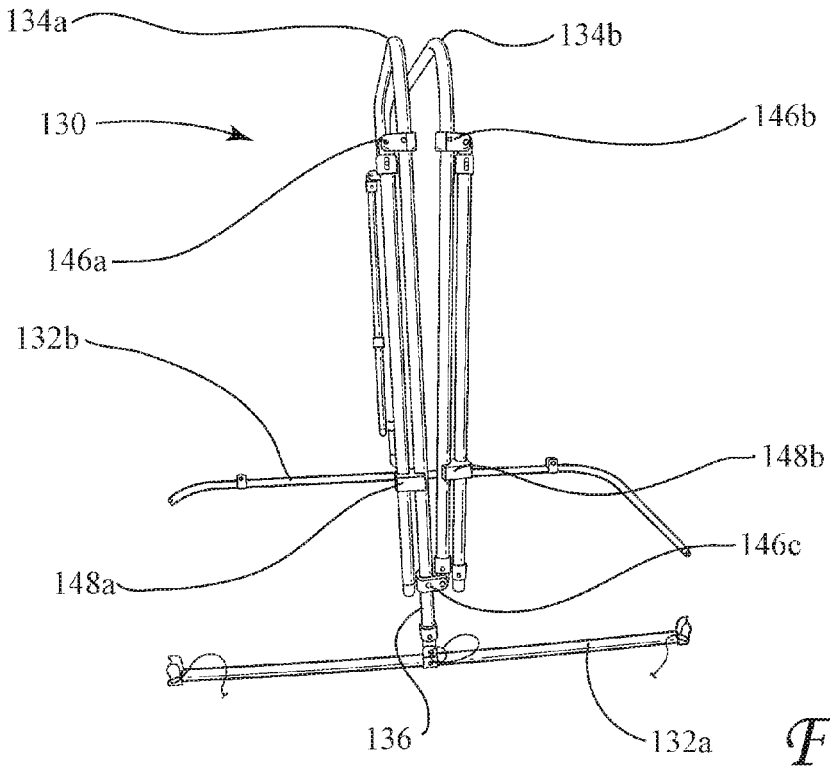
Fig. 13
Fig. 14
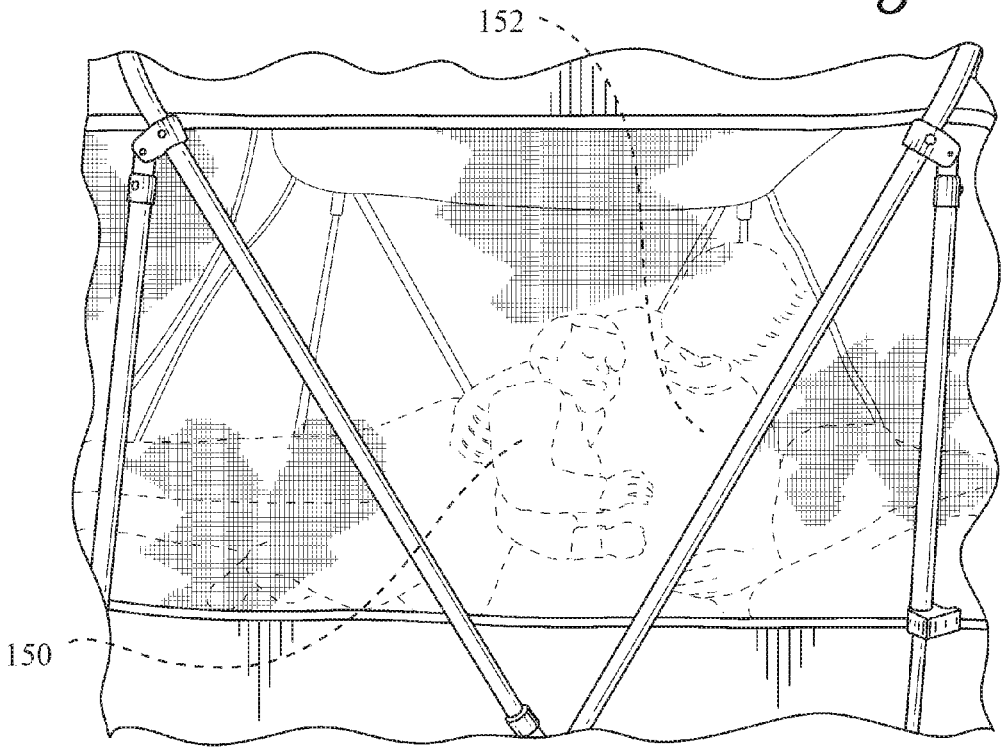

PORTABLE CONFINEMENT DEVICE

BACKGROUND OF THE INVENTION

1. Field of the Invention

The invention relates to a portable confinement device for confining a person upon a mattress. The device is useful for taking care of children and adults who need to be kept from wandering away from their sleeping or resting areas.

2. Background of the Art

The need for the confinement of a person may result from some form of mental or physical ailment that makes it necessary for a caregiver to be assured of the person's whereabouts at sleep or resting times. Over the years, many schemes have been devised to confine a child or an adult to their sleeping or resting areas, without the use of straps or other body attachments. Unlike camping or play tents or beds (see for example, U.S. Pat. Nos. 7,472,436 B1, 7,174,584 B2, 7,100,221 B1, 6,952,844 B2, 6,728,981 B1, 6,220,264 B1, 6,192,909 B1, 5,449,014, 4,852,598, 4,531,330, 4,237,914, and 3,578,003, U.S. Publication Nos. 2008/0216881 A1 and 2006/0266399 A1, and U.K. Pat. No. 444,761), a confinement device has to be capable of keeping the person inside the device until the caregiver determines it is safe for the person to leave it. Among the many examples of prior art confinement devices are those described in U.S. Pat. Nos. 7,434,280 B2, 7,383,849 B2, 7,062,806 B2, 7,047,991 B2, 6,772,458 B2, 6,687,930 B1, 6,487,735 B1, 6,263,529 B1, 6,216,291 B1, 5,784,732, 5,384,925, and 4,641,387, and U.S. Publication No. 2007/0294827 A1. Many of these devices, like those described in U.S. Pat. Nos. 7,383,849 and 6,487,735 B1 and U.S. Publication No. 2007/029487, are expensive and very heavily constructed for hospital or institutional use, and are often fitted with wheels or casters for conveyance from one location to another. Others, such as those described in U.S. Pat. No. 7,434,280 B2, are very bulky, take a large amount of effort to assemble, and are difficult to transport from one location to another.

Thus, although this art field is very crowded, there are still some needs which, up until now, have gone unsatisfied. What is needed is an inexpensive, stable, lightweight confinement device which is readily portable and easily assembled.

SUMMARY OF THE INVENTION

The present invention satisfies the foregoing needs by providing a novel portable confinement device which is useful for confining a child or an adult while they are sleeping, resting, relaxing, or playing without the use of straps or other a body attachments. Moreover, while the durable construction of the present invention permits it to be used every day in the confined person's home, its portability allows it to be easily transported and used on trips away from the home. This feature provides the confined person with the security and comfort of familiar surroundings even when spending nights away from home.

The present invention provides embodiments of a portable confinement device for confining a person upon a mattress wherein the confinement device comprises a frame and a flexible enclosure that is supported by the frame and which sits upon the frame to help keep the confinement device from tipping over. The frame comprises a base and an upright portion that is connected to the base. Preferably, the base has two sides which are parallel to one another and set apart at a distance. The upright portion preferably has two bridge sections from which the top of the enclosure is suspended. Each of the bridge sections has a center portion and legs depending from the center portion. Each of the leg ends of one of the bridge sections is attached to one or the other of the two sides of the base and each of the leg ends of the other bridge section is attached to one or the other of the legs of the first bridge section so that the four legs of the two bridge sections meet to form two vees. The upright portion also preferably includes four supports. Each of the supports is connected to one of the two sides of the base and to one of the legs of the bridge sections. The enclosure is made of durable, flexible materials and has sides, a floor, and a roof which define an interior space for confining a person. At least one of the sides of the enclosure has a fastenable opening through which a person may enter and exit the interior space. This opening is constructed so that it can be unfastened only from outside of the enclosure. This feature prevents the confined person from exiting the enclosure without the help of his or her caregiver who is outside of the enclosure. The enclosure is constructed to receive a mattress, either into the interior space or into a pocket located under the floor of the interior space. At least one of the roof and the sides of the enclosure has a mesh window for providing ventilation and light into the interior space. The mesh window also makes it possible for a confined person and an outside caregiver to see one another.

Some embodiments of the present invention include the mattress, which is preferably an inflatable mattress. Some embodiments of the present invention also include a carrying bag into which the frame and the enclosure, and optionally, the mattress, may be placed for transportation or storage.

BRIEF DESCRIPTION OF THE DRAWINGS

The criticality of the features and merits of the present invention will be better understood by reference to the attached drawings. It is to be understood, however, that the drawings are designed for the purpose of illustration only and not as definitions of the limits of the present invention.

FIG. 13 is a perspective view of a partially assembled frame of a portable confinement device according to an embodiment of the present invention.

FIG. 14 is a side view of a portable confinement device according to an embodiment of the present invention.

DESCRIPTION OF PREFERRED EMBODIMENTS

In this section, some preferred embodiments of the present invention are described in detail sufficient for one skilled in the art to practice the present invention. It is to be understood, however, that the fact that a limited number of preferred embodiments are described herein does not in any way limit the scope of the present invention as set forth in the appended claims.

Figure 1:
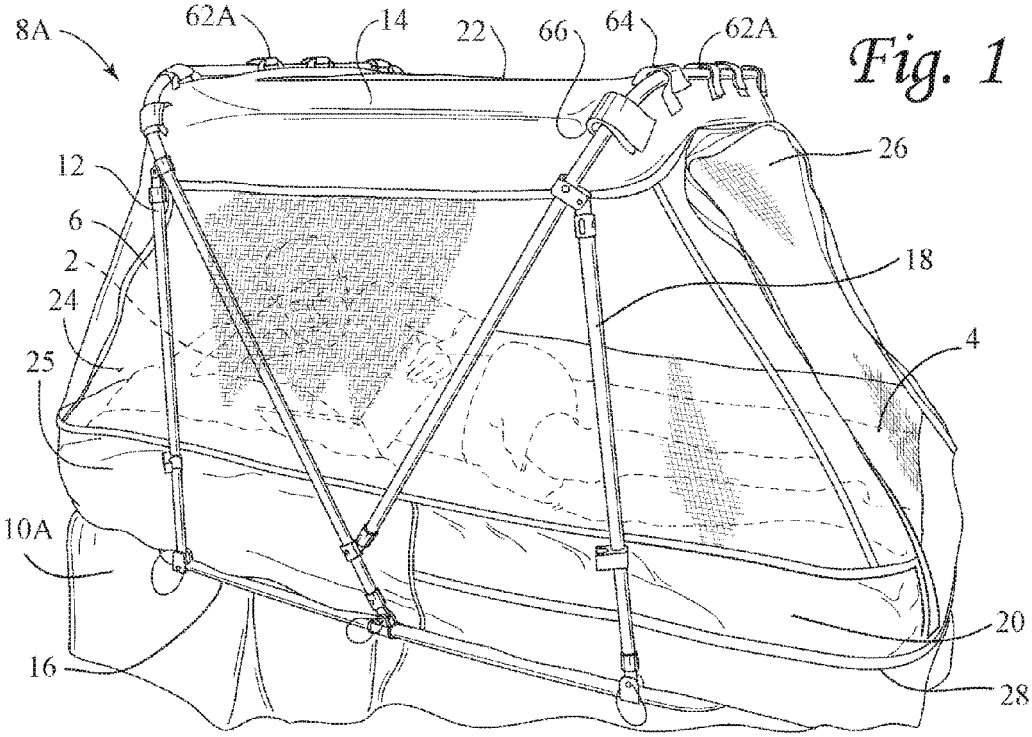
FIG. 1 is a perspective view of a portable confinement device according to an embodiment of the present invention, supported by a box spring, showing a confined person relaxing within the device.

Referring to FIG. 1, there is shown a person 2 relaxing upon a mattress 4 within the interior space 6 a portable confinement device 8A according to an embodiment of the present invention. The confinement device 8 is sitting upon a skirted box spring support 10A. The confinement device 8A has frame 12 and a flexible enclosure 14. The frame 12 has a base 16 and an upright portion 18. The top of the enclosure 14 is suspended from the upright portion 18 while the bottom of the enclosure 8A rests upon the base 16 to stabilize the confinement device 8A from tipping over. The sides 20 and the roof 22 of the enclosure 14 have mesh windows 24 to provide ventilation and light to the interior space 6. There is fastenable opening 26 in one of the sides 20 to allow the person 2 to enter and leave the interior space 6. There is also a second fastenable opening 28 for inserting the mattress 4 into the interior space 6.

Figure 2:
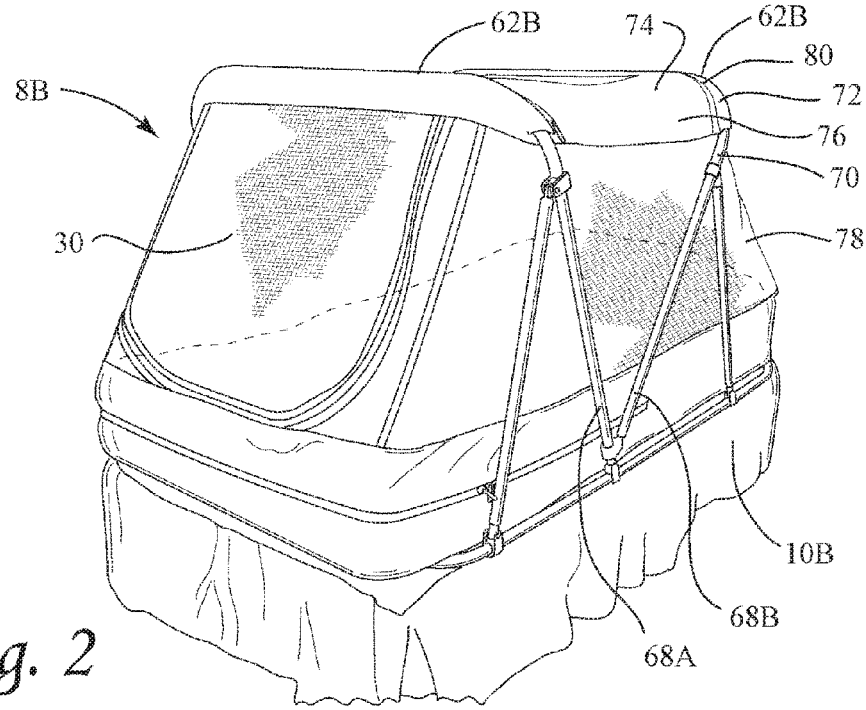
FIG. 2 is a perspective view of a portable confinement device according to another embodiment of the present invention, supported by a box spring.
Figure 3:
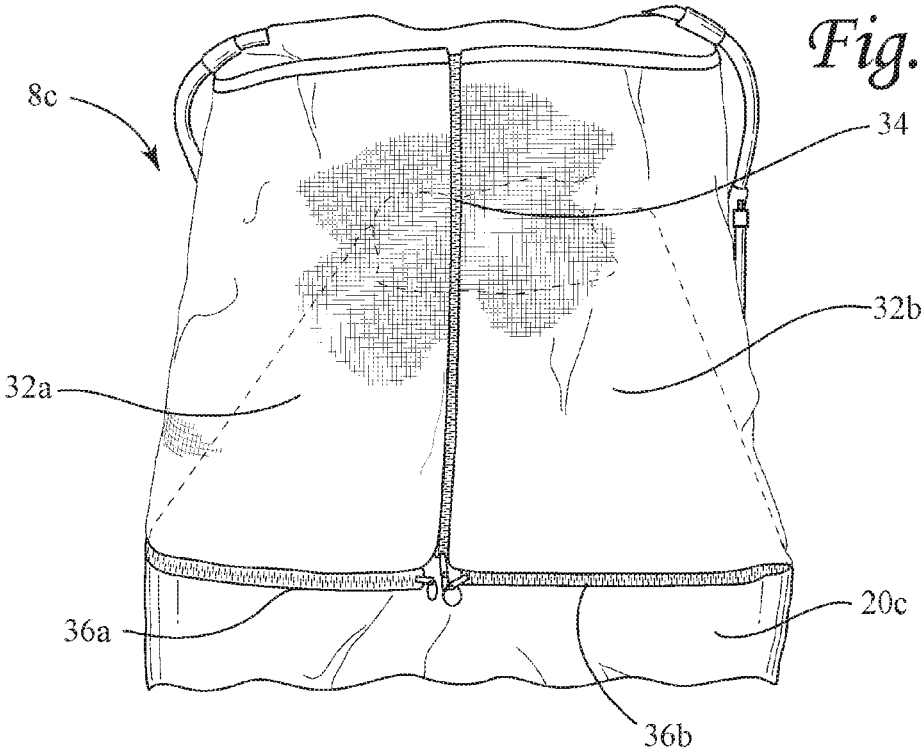
FIG. 3 is an end view of a portable confinement device according to yet another embodiment of the present invention.

Referring now to FIG. 2, there is shown another portable confinement device 8B according to another embodiment of the present invention sitting upon a skirted box spring support 10B. Referring now to FIG. 3, there is shown yet another portable confinement device 8C according to another embodiment of the present invention. While each of the embodiments shown in FIGS. 1-3 is of similar general construction, the fastenable openings for entering and leaving the interior of the confinement devices 8A and 8B are, respectively a downward opening door panel 26 and an upward opening door panel 30, while that of confinement device 8C is made up of two flaps 32*a* and 32*b* which fasten together along zipper 34 and fasten along their bottoms to the side 20C by way of zippers 36*a* and 36*b*.

Figure 4:
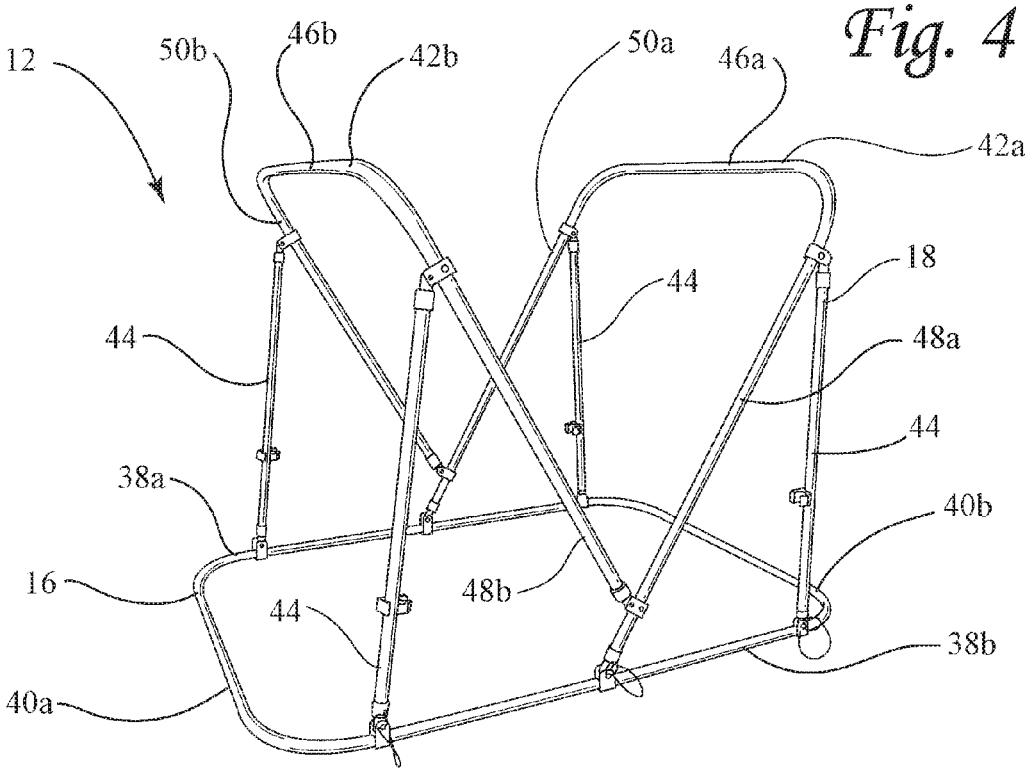
FIG. 4 is a perspective view of the frame of a portable confinement device according to an embodiment of the present invention.

An embodiment of the frame 12 of the present invention is shown by itself in FIG. 4. The base 16 of the frame 12 has two sides 38*a*, 38*b* which are parallel to one another and set apart at a preselected distance. In this embodiment, the base 16 also includes two additional sides, 40*a*, 40*b*, which interconnect the two sides 38*a*, 38*b*. Some embodiments of the present invention include additional stabilizing elements, e.g., plates or corner cross braces, in the plane of the base to provide additional structural stability to the base or for better overall stability of the confinement device. The upright portion 18 includes two bridge sections, first bridge section 42*a* and second bridge section 42*b*, and four supports 44. The first bridge section 42*a* has a center section 46*a* from which depend two legs 48*a* and 50*a*. Likewise, the second bridge section 42*b* has a center section 46*b* from which depend two legs 48*b* and 50*b*.

The frame components described in the previous paragraph may be solid or hollow rods or bars of any cross-sectional shape. Preferably they are tubes of circular cross-sectional shape. They may be made of plastic, metal, composite, or any other material that provides the requisite structural properties. Preferably, they are constructed to provide a combination of low weight and good structural strength to the frame 12. In some preferred embodiments, these frame components are steel or aluminum tubes.

The upright portion 18 is attached to the base 16 in the following manner. Referring still to FIG. 4, it can be seen that each of the terminal ends of the legs 48*a*, 50*a* of the first bridge section 42*a* attaches to one or the other of base sides 38*a*, 38*b*. It can also be seen that each of the terminal ends of the legs 48*b*, 50*b* of the second bridge section 42*b* attach to one or other of the legs 48*a*, 50*a* of the first bridge section 42*a* so as to form a vee. It is preferred that the location of this attachment be selected so that the attachment point is the apex of an inverted isosceles triangle which has the intersecting legs, e.g., legs 48*a* and 48*b*, as its sides of equal length and an imaginary line connecting the distal ends of those legs as its base. FIG. 4 also shows that one end of each of the supports 44 attaches to a leg of one of the first and second bridge sections 42*a*, 42*b* and the other end of each of the supports attaches to one or the other of base sides 38*a*, 38*b*. Preferably, one or more of the attachments described in this paragraph is non-permanent. However, it is also within the contemplation of the present invention that any or all of the attachments described in this paragraph be permanently made.

Figure 5:
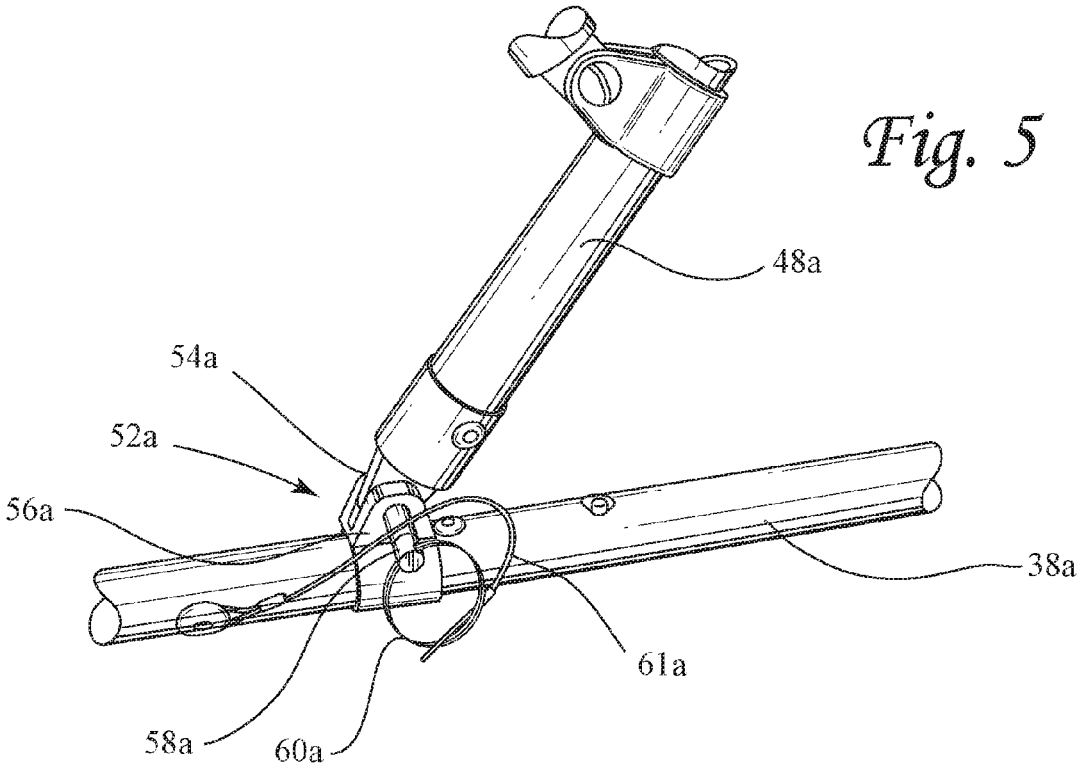
FIG. 5 is a perspective side view of one of the points of attachment of the first bridge section to a base side and of the second bridge section to the first bridge section according to an embodiment of the present invention.
Figure 6:
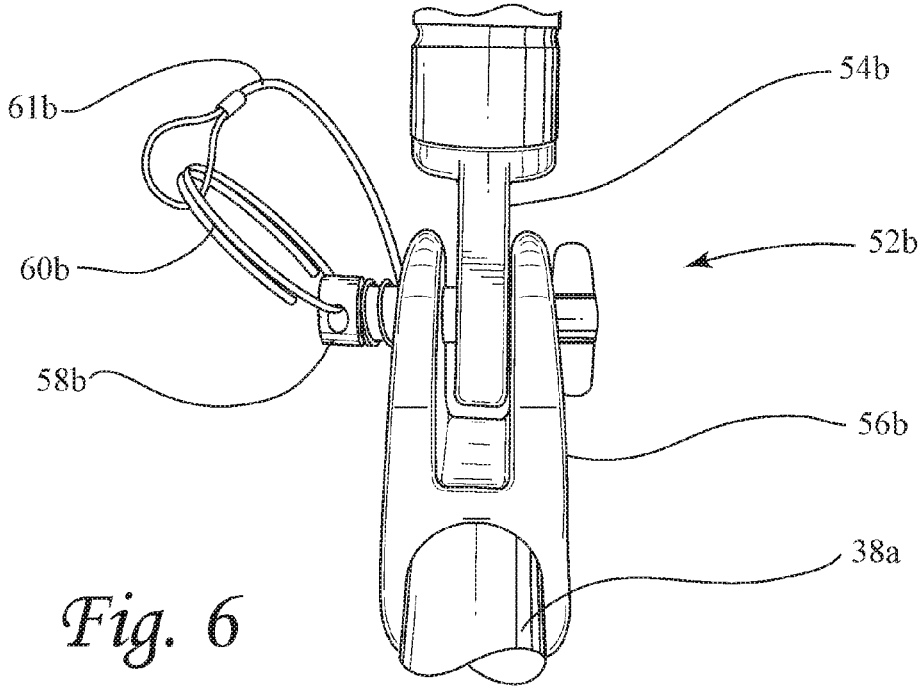
FIG. 6 is a front view of the point of attachment of a support to a base side of the frame according to an embodiment of the present invention.

Any means of attachment known to persons skilled in the art may be used to make the attachments described in the previous paragraph. Preferred means of attachment are illustrated in FIGS. 5 and 6. Referring now to FIG. 5, there is shown the attachment of the terminal end of leg 48*a* to base side 38*a* by means of an eye and pin connector system, e.g. connector system 52*a*. The connector system 52*a* includes an eye end 54*a* which is pinned to a receiving jaw 56*a* by a spring loaded toggle pin 58*a*. The eye end 54*a* is riveted to the terminal end of leg 48*a* and the receiving jaw 56*a* is riveted to the base side 38*a*. The toggle pin 58*a* is preferably tethered by way a connecting ring 60*a* and a small ligature 61*a* to the base side 38*a* to prevent loss of the toggle pin 58*a* when it is not in use. FIG. 6 shows the use of a similar eye and pin connector system 52*b* having an eye end 54*b* pinned to receiving jaw 56*b* by a spring loaded toggle pin 58*b*. The toggle pin 58*b* is preferably tethered by way of connecting ring 60*b* and a small ligature 61*b* to base side 38*a*. The connector system 52*b* differs from the connector system 52*b* mainly in materials construction, as some portions of the connector system 52*b* are plastic while all of the portions of connector system 52*a* are steel.

Referring again to FIG. 1, at some point during the assembly of the portable enclosure device 8A, the enclosure 14 is made to be supported by the frame 12. Although any means known to persons skilled in the art of arranging such support is within the contemplation of the present invention, it is preferred that the support be provided by attaching the enclosure 14 to the frame 12. It is even more preferred that the enclosure 14 be removably attached to the frame 12. Preferably, only the top of the enclosure 14 is attached to the frame 12, but in some embodiments of the present invention, the sides 14 and/or the bottom of the enclosure 14 are also be attached to the frame 12. Although any means of attachment known to a person skilled in the art may be used to attach the enclosure 14 to the frame 12, it is preferred to make the attachment by providing the enclosure 14 with a plurality of pockets 62A which are adapted to encircle portions of the frame 12. The pockets 62A shown in this embodiment are all of about the same length and comprise a flap 64 that has one end sewn to the roof 22 or a side 20 of the enclosure 14 and a small strap 66 that is located the width of the pocket away from the sewn end of the flap 64. The ends of the strap 66 are sewn to the roof 22 or a side 20 of the enclosure 14 so that the free end of the flap 64 may be passed under and around the strap 66 after it has been passed over a portion of the frame 12. The flap 64 has a hook section and corresponding loop section attached to one of its sides so that they can fasten together to secure a portion of the frame 12 in the pocket 62A formed by the flap 64 passing under and around the strap 66.

Referring now to FIG. 2, there is shown another arrangement for attaching the enclosure 14 to the frame 12. In this embodiment, only two pockets 62B are used. Each of the pockets 62B encircles the entire center section of one or the other of the first and second bridge sections 68*a*, 68*b* of the frame 70. Each of the pockets 62B is formed by a flap, e.g., flap 72, that has one end sewn to the roof 74 and sides 76 of the enclosure 78. A zipper 80 is used to fasten the free end of the flap 72 to the roof 74 and the sides 76 to enclose the center section of one of the bridge sections, e.g., first bridge section 68, within the pocket 62B.

Figure 7:
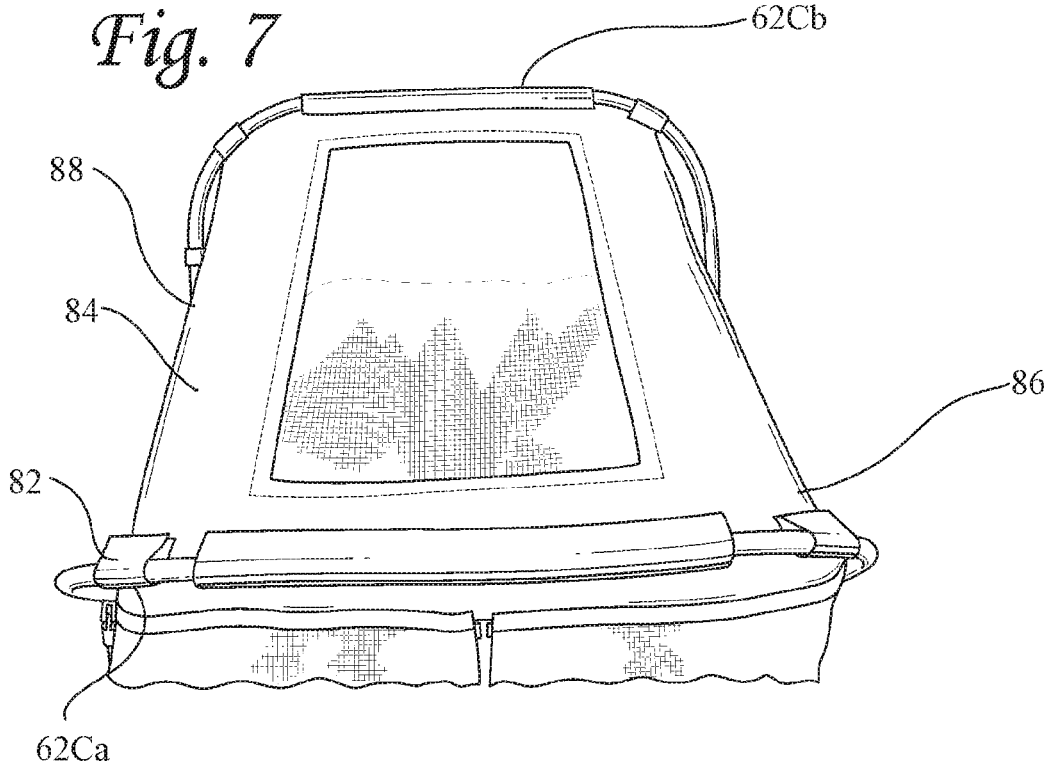
FIG. 7 is a perspective top view of the embodiment of the present invention shown in FIG. 3 and illustrates a window in the roof of the enclosure.

Referring now to FIG. 7, there is shown yet another arrangement for attaching the enclosure to the frame. FIG. 7 shows the top of the embodiment of the present invention that is shown in FIG. 3. In this embodiment four short pockets 62Ca and two long pockets 62Cb are used. Each of the pockets 62Ca, 62Cb is formed by a flap, e.g., flap 82 that has one end sewn to the roof 84 or one of the sides 86 of the enclosure 88. A hook and loop fastener is used to fasten the free end of the flap 82 to the roof 84 or one of the sides 86 of the enclosure 88 to enclose a portion of the frame within the pocket, e.g. pocket 62Ca.

Referring again to FIG. 1, the flexible enclosure 14 is constructed of strong, durable materials so that it is effective in confining a person and can be used daily for weeks, months, or even years. Any suitable materials known to persons skilled in the art may be used for making the enclosure 14. The materials are preferably fire-retardant. Particularly preferred materials are a black vinyl encapsulated polyester mesh with a 30 percent openness factor for the mesh windows 24 and canvas for the non-mesh portions 25.

Likewise, the fasteners for the enclosure 14 are to be strong, durable, and easy to use. Zippers and hook and loop fasteners are particularly preferred, but any fasteners known to persons skilled in the art may be used, including ligatures. Some types of fasteners are appropriate for some uses but not others, depending on the accessibility of the fastener to a person inside the enclosure. For example, zippers, hook and loop fasteners, sewn loops or pockets, buttons, snaps, and ligatures may all be used for attaching the enclosure 14 to the frame 12, whereas of this group of fasteners, only the zippers, hook and loop fasteners, and ligatures are preferred for use with the opening for a person's entry and exit 26 and the opening for mattress insertion 28. Particularly preferred zippers have teeth made of acetyl resin, e.g., Delrin®, and tapes made of polyester. One such preferred zipper is the Vision® VFUVIK107DX #10 chain zipper available from the YKK Corporation of Tokyo, Japan.

Figure 8:
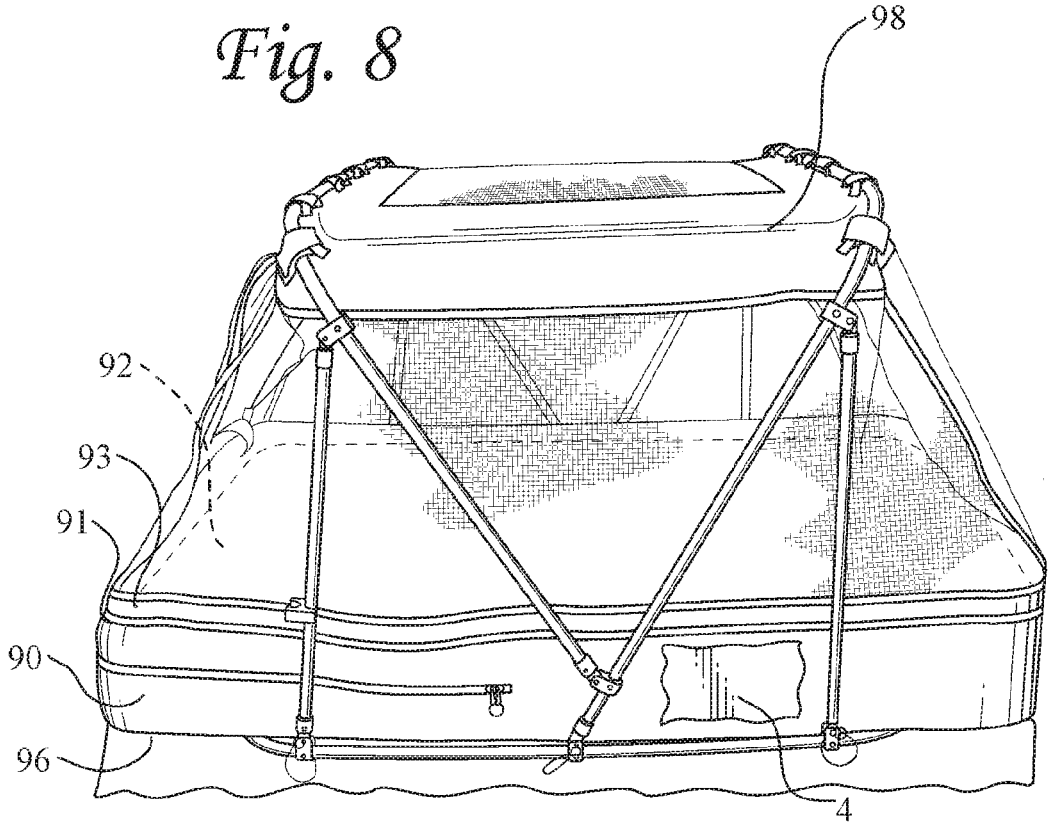
FIG. 8 is a perspective partial cutaway side view of a portable confinement device according to an embodiment of the present invention wherein the enclosure has a mattress pocket.

The present invention contemplates the use of the inventive portable enclosure device with a mattress upon which the confined person may sleep, rest, relax, or play. Although any type of mattress known to persons skilled in the art may be used with the present invention, the mattress is preferably inflatable. Some of the embodiments of the present invention include a mattress, while other embodiments do not and the mattress may be separately supplied. All of the embodiments of the present invention are adapted to receive a mattress. Referring again to FIG. 1, the mattress 4 may be received into the interior space 6 of the enclosure 14 either by way of the opening 26 that is otherwise used for entry and exit of a person or by way of an opening 28 that is specially provided for inserting or withdrawing the mattress 4. Referring now to FIG. 8, the mattress 4 may also be received into a mattress pocket 90 (portion of the enclosure 14 that is below seam 91) that is defined by the underside of the floor 92 (attached to the sides 93 at seam 91), the lower portions of the sides 94, and the bottom 96 of the enclosure 98. The mattress pocket 90 prevents a confined person from burrowing under the mattress 4 and possibly getting trapped there.

Figure 9:
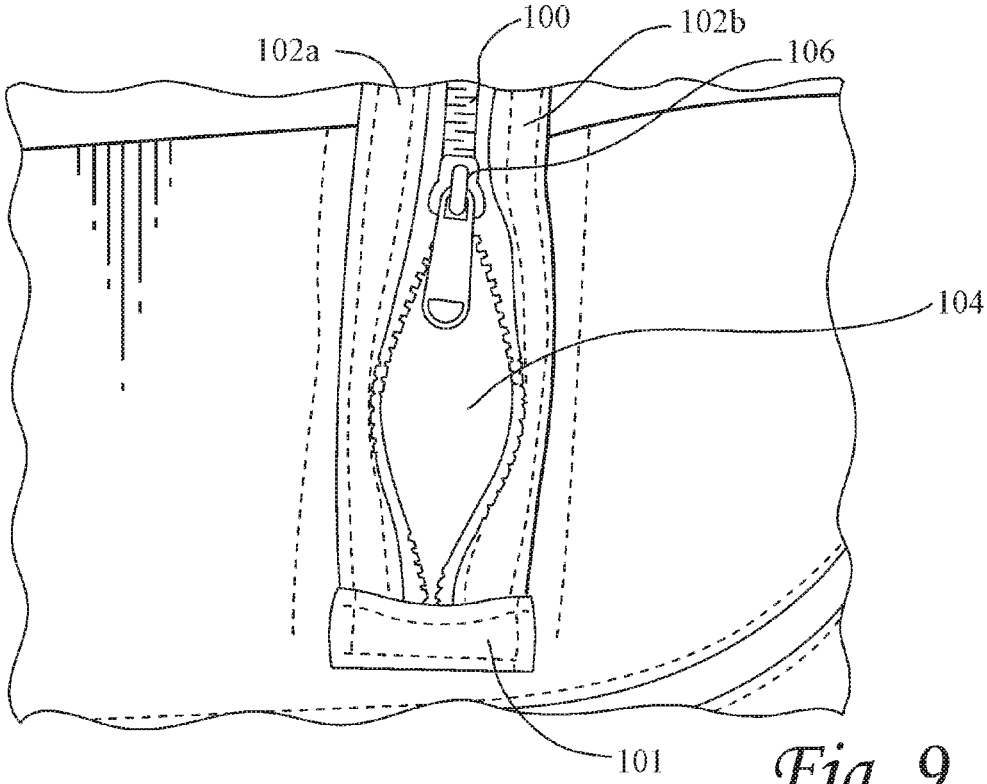
FIG. 9 is a detail of a front view of the embodiment of the present invention shown in FIG. 2 and illustrates the end of a zipper fastener arranged to allow opening only from outside of the enclosure.
Figure 10:
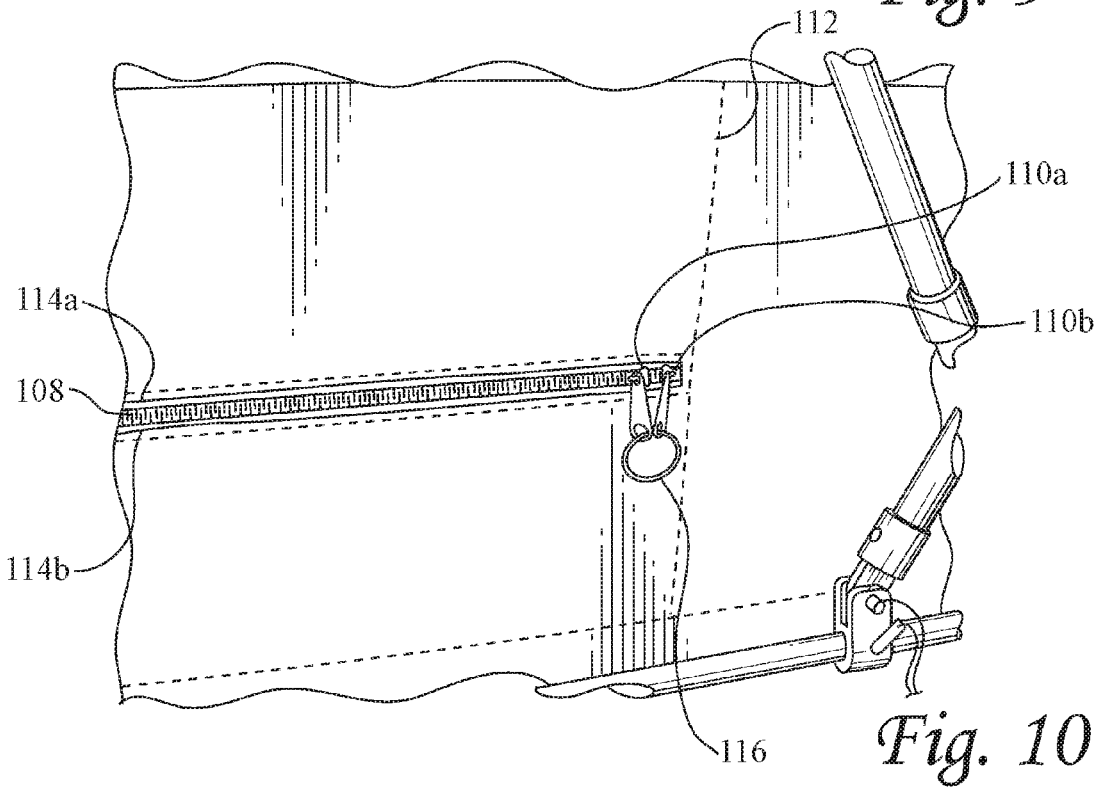
FIG. 10 is a detail of perspective side view of a detail of the embodiment of the present invention shown in FIG. 2 and illustrates a means of locking the mattress opening so that it may be opened only from outside of the enclosure.

An important feature of the present invention is that the fastenings for any opening through which a person may exit the enclosure are unfastenable only from outside the enclosure. Any means or combination of means known to those skilled in the art may be used to provide this feature. Two examples are shown in FIGS. 9 and 10 for preventing a zipper fastener from being opened from inside the enclosure. Referring to FIG. 9, where a single-slide zipper 100 is used, a fabric strip 101 is sewn in place between the ends of the zipper tapes 102*a*, 102*b* and across the zipper stop (hidden by the fabric strip) to prevent the end of the zipper 100 from pulling apart and a backing 104 is provided for more than a finger's length of the zipper 100 from the stop so that a person inside of the enclosure cannot reach the zipper slide 106 when it is parked against the stop. FIG. 10 shows a zipper 108 having two slides 110*a*, 110*b*. Here, a seam 112 is sewn between the ends of the zipper tapes 114*a*, 114*b* and across the zipper stop to prevent the end of the zipper 108 from pulling apart and a locking ring 116 is used to lock together the two zipper slides 110*a*, 110*b*.

Figure 11:
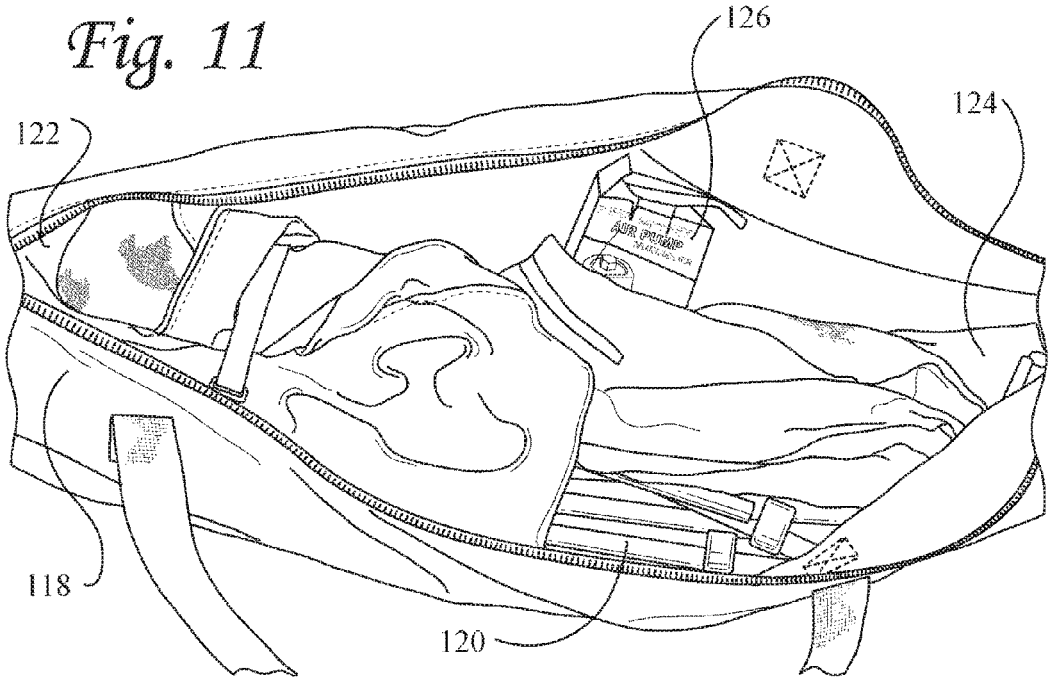
FIG. 11 is a perspective view of an open carrying bag containing a frame, enclosure, inflatable mattress and optional air pump according to an embodiment of the present invention.

Some embodiments of the present invention include a carrying bag to transport and store the portable confinement device. Referring now to FIG. 11, there is shown a carrying bag 118 opened to show its contents. The contents consist of the various parts of a disassembled confinement device i.e., components of the frame 120, a flexible enclosure 122, and an inflatable mattress 124, along with an air pump 126 for inflating the mattress 124.

Figure 12:
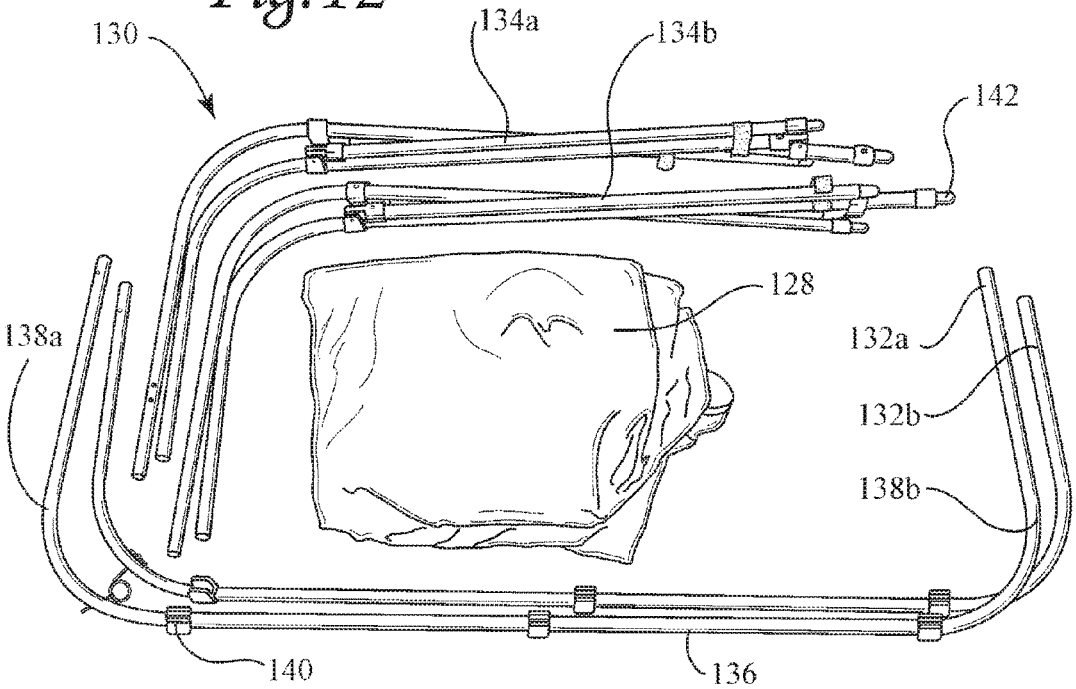
FIG. 12 is a perspective view of a disassembled portable confinement device according to an embodiment of the present invention.

Referring now to FIGS. 12 and 13, there is shown a preferred embodiment of the present invention having features to enhance portability and ease of assembly. Referring now to FIG. 12, there is shown the folded-up enclosure 128 and the frame components 130 of a disassembled portable confinement device. The frame components 130 include two base sections 132*a*, 132*b* and two upright sections 134*a*, 134*b*. Each of the frame components 130 comprises a hollow steel tube. Each of the two base sections 132*a*, 132*b* comprises a midsection, e.g., midsection 136, and two legs 138*a*, 138*b*. The midsection 136 corresponds to one or other of the base sides 38*a*, 38*b* shown in FIG. 4. The ends of the of the two base sections 132*a*, 132*b* fit and lock together in cylindrical butt-lap joints having push button locks. Jaws of eye and pin connector systems, e.g., jaw 140, are fixed onto each of the base sections 132*a*, 132*b* for receiving corresponding eye ends of the upright sections 134*a*, 134*b*, e.g., eye end 142. Each of the upright sections 134*a*, 134*b* gangs together two supports and two half sections of a bridge section, which are divided at about the midpoints of their center sections. The corresponding sides of the bridge sections fit and lock together in cylindrical butt-lap joints having push button locks.

FIG. 13 shows the frame 130 in a partially assembled state. The two base sections 132*a*, 132*b* are joined together as are the two upright sections 134*a*, 134*b*. The ends of the first bridge section 136 are attached to one or other of the base sides 138*a*, 138*b*. The upright section 134*a* in the foreground shows how its various components are ganged together using pivotable, fixed pin, eye and pin joints 146*a*, 146*b*, 146*c*. Snap-lock brackets 148*a*, 148*b* are used to keep adjacent tubular section together during handling and storage.

The portable confinement devices of the present invention may sized to fit any size of mattress. The height of head room provided above the mattress top is preferably on the order of the width of the mattress to help guard against the confined person's movements tipping over the device, but may vary from this to provide sufficient room for a person to comfortably move about. It is also preferred that the interior space be large enough to comfortably accommodate the confined person 150 and the person's caregiver 152, as illustrated in FIG. 14.

While only a few embodiments of the present invention have been shown and described, it will be obvious to those skilled in the art that many changes and modifications may be made thereunto without departing from the spirit and scope of the present invention as described in the following claims. All patent applications, patents, and all other publications referenced herein are incorporated herein in their entireties to the full extent permitted by law.

What is claimed is:

1. A portable confinement device for confining a person upon a mattress, the device comprising:

a) a frame having:

i) a base having first and second tubular base sides which are parallel to one another and set apart from one another at a preselected distance, and ii) an upright portion having first and second bridge sections, and at least four supports, each of the first and second bridge sections having a center section and two parallel legs depending from the center section, wherein the first bridge section is attached to each of the first and second base sides, each of the legs of the second bridge section is attached, respectively, to one of the legs of the first bridge section, and each of the supports is attached to one of the first and second base sides and to one of the legs of the first and second bridge sections; and b) a flexible enclosure having a bottom and being supported by the frame and adapted to receive a mattress, the enclosure further having a floor, sides, and a roof defining an interior space, wherein at least one of the sides has a fastenable first opening to permit a person ingress to and egress from the interior space, the first opening being adapted to be unfastened only from outside of the enclosure, and at least one of the roof and the sides having a mesh window for providing ventilation and light to the interior space;

wherein the bottom of the enclosure rests upon the base to stabilize the confinement device from tipping over.

2. The portable confinement device of claim 1, wherein the enclosure further comprises at least one first pocket for receiving a portion of the first bridge section and at least one second pocket for receiving a portion of the second bridge section.

3. The portable confinement device of claim 2, wherein a portion of least one of the first and second pockets is reversibly fastened to the enclosure by at least one selected from the group consisting of a snap, a button, a hook and loop fastener, a zipper, and a ligature.

4. The portable confinement device of claim 1, wherein the enclosure has a fastenable second opening through which the mattress may be put into or removed from the enclosure interior space and the fastenable second opening is reversibly fastened by at least one selected from the group consisting of a hook and loop fastener, a zipper, and a ligature.

5. The portable confinement device of claim 1, wherein the enclosure further comprises a pocket into which the mattress is received.

6. The portable confinement device of claim 1, wherein the frame further comprises at least one spring loaded toggle pin adapted to removably attach at least one of the legs of the first bridge section to at least one of the first and second base sides or at least one of the supports to one of the first and second base sides or to one of the legs of the first and second bridge sections.

7. The portable confinement device of claim 1, wherein each of the legs of the second bridge section is pivotably attached to one or the other of the legs of the first bridge section.

8. The portable confinement device of claim 1, wherein the apex of an inverted isosceles triangle is formed at each of the attachment points of the legs of the second bridge section to the corresponding legs of the first bridge section.

9. The portable confinement device of claim 1, wherein at least one of the first and second bridge sections and the supports is a tube.

10. The portable confinement device of claim 1, wherein the base further comprises third and fourth base sides interconnecting the first and second base sides.

11. The portable confinement device of claim 1, wherein the first, second, third, and fourth base sides are formed of two interconnecting sections.

12. The portable confinement device of claim 11, wherein at least one of the interconnecting sections is a tube.

13. The portable confinement device of claim 1, further comprising a carrying bag adapted to contain the base and the enclosure.

14. A portable confinement device for confining a person upon a mattress, the device comprising:

a) a mattress;

b) a frame having:

i) a base having first and second tubular base sides which are parallel to one another and set apart from one another at a preselected distance; and ii) an upright portion having first and second bridge sections, and at least four supports, each of the first and second bridge sections having a center section and two parallel legs depending from the center section, wherein the first bridge section is attached to each of the first and second base sides, each of the legs of the second bridge section is attached, respectively, to one of the legs of the first bridge section, and each of the supports is attached to one of the first and second base sides and to one of the legs of the first and second bridge sections;

c) a flexible enclosure having a bottom and being supported by the frame and receiving the mattress rested on the bottom, the enclosure further having a floor, sides, and a roof defining an interior space, wherein at least one of the sides has a fastenable first opening to permit a person ingress to and egress from the interior space, the first opening being adapted to be unfastened only from outside of the enclosure, and at least one of the roof and the sides having a mesh window for providing ventilation and light to the interior space;

wherein the bottom of the enclosure rests upon the base to stabilize the confinement device from tipping over.

15. The portable confinement device of claim 14, wherein the mattress is an inflatable mattress.

16. The portable confinement device of claim 14, further comprising a carrying bag adapted to contain the base, the enclosure, and the mattress.

* * * * *